US005498299A

United States Patent [19]

Schmidt

[11] Patent Number: 5,498,299

[45] Date of Patent: Mar. 12, 1996

[54] PROCESS FOR AVOIDING SURFACE OXIDATION IN THE CARBURIZATION OF STEELS

[75] Inventor: Hans-Peter Schmidt, Mettmann, Germany

[73] Assignee: Messer Griesheim GmbH, Frankfurt, Germany

[21] Appl. No.: 319,166

[22] Filed: Oct. 6, 1994

[30] Foreign Application Priority Data

Jan. 9, 1994 [DE] Germany ..... 44 00 391.9

[51] Int. Cl.$^6$ ..... C21D 9/00; C21D 1/74

[52] U.S. Cl. ..... 148/210; 148/207; 148/218; 148/225; 148/280

[58] Field of Search ..... 148/207, 210, 148/218, 225, 280

[56] References Cited

U.S. PATENT DOCUMENTS

| | | | |
|---|---|---|---|
| 4,049,473 | 9/1977 | Davis | 148/225 |
| 4,175,986 | 11/1979 | Ewalt | 148/218 |
| 4,769,090 | 9/1988 | Queille | 148/225 |
| 4,935,073 | 6/1990 | Bartlett | 148/280 |
| 5,045,126 | 9/1991 | Comier | 148/218 |
| 5,143,558 | 9/1992 | Smith | 148/218 |

*Primary Examiner*—Sam Silverberg
*Attorney, Agent, or Firm*—Connolly & Hutz

[57] ABSTRACT

The surface oxidation under carburization temperatures of steels during the carburization with carbon-containing gas mixtures is avoided by heating the steels to the carburization temperature under a nitrogen/hydrogen mixture or pure hydrogen. For carburization, these gases are replaced by a carbon-containing gas mixture whose oxygen activity is smaller than that required for the formation of manganese(II) oxide or chromium(III) oxide.

11 Claims, No Drawings

PROCESS FOR AVOIDING SURFACE OXIDATION IN THE CARBURIZATION OF STEELS

BACKGROUND OF THE INVENTION

In case-hardening, steels of low carbon content are annealed in carbon-releasing agents at temperatures of between 800° and 950° C. The surface is enriched with carbon and becomes hard on quenching. The carbon-releasing agents used are in most cases endothermic gases which contain about 20% of CO, 40% of $H_2$ and 40% of $N_2$. During the carburization of these steels with endothermic gas, an oxidation of the base alloy elements occurs in the surface zone of the steels, so that these are no longer present during the later formation of the microstructure. In the surface zone of the steels, an undesired microstructure forms in this case, which has unfavorable properties and requires mechanical removal or sandblasting of this surface zone in order to obtain the required properties of the steels (workpieces).

Investigations have shown that this surface oxidation is essentially caused by the oxygen potential of the endothermic gases used, even though these gases have a strongly reducing action and no "free oxygen" is present at the particular carburization temperature. The oxygen activity is determined by the contents of CO, $CO_2$ and $H_2O$ and by the non-oxygen-containing components ($H_2$ and $CH_4$). The dominating carburization part reaction in such CO-containing gas atmospheres is the carbon monoxide decomposition on the workpiece surface:

$$CO_{gas}=[C]_{dissolved}+[O]_{adsorbed}$$

The released carbon, and also the adsorbed oxygen produced in the reaction, are dissolved by the alloy and diffuse into the steel. The quantity of dissolved oxygen is determined by the oxygen activity of the gas phase and by the duration of the treatment time and it is very much smaller than the quantity of carbon being dissolved. The oxygen solubility in pure iron is approximately 0.0003% by weight of oxygen (3 ppm of oxygen) at 950° C. and a C level of 1% by weight of carbon when an endothermic gas of methane is used.

If the oxygen partial pressure for the formation of a metal oxide is exceeded, oxidation of the particular metal takes place.

$$Me+H_2O=MeO+H_2$$

$$Me+CO_2=MeO+CO$$

The oxygen potential of the carburization media used is as a rule so low that no oxidation of the iron takes place. Alloy elements present in the steels, however, have a high oxygen affinity, so that small quantities of dissolved oxygen in the alloy lead to the so-called internal oxidation.

Conventional alloy elements are: Cr, Mn, Si, Ti, V and others which are present in low concentrations. Surface oxidation or also internal oxidation is understood as precipitations of oxides of the abovementioned metals within a metal grain or along the grain boundaries, which precipitations are formed by the dissolved oxygen diffusing in and are then dispersely distributed in the matrix.

The kinetics of the oxygen uptake obey a diffusion-controlled time law, and the depth of penetration thus increases parabolically with the duration of carburization. The depth of penetration of the oxygen and the thus resulting depth of surface oxidation can be calculated by the following equation:

$$X_t^2=\frac{2\cdot(D_o\cdot C_o)}{\nu\cdot C_{Me}}\cdot t=k_p\cdot t$$

$$X_t=\sqrt{k_p\cdot t}$$

$X_t$ depth of penetration of the oxygen
$D_o$ diffusion coefficient of the oxygen in the alloy
$C_o$ oxygen concentration from the alloy surface
$C_{ME}$ concentration of the base metal in the alloy (for example silicon)
$\nu$ stoichiometric factor

SUMMARY OF THE INVENTION

The invention is based on the object of preventing surface oxidation during the carburization of steels.

The invention provides a carburization process with only low equipment costs and operating costs, because the annealing can be carried out at atmospheric pressure in conventional industrial furnace installations.

According to the invention, the surface oxidation of the steels is avoided as a result of the heat treatment being carried out in gas phases which contain only small quantities of oxygen-containing molecules or none at all. During the carburization of these steels, the oxygen partial pressure of the gas atmosphere does not exceed the formation pressure of the oxides.

DETAILED DESCRIPTION

The gas components, namely hydrogen and hydrocarbons, of the gas mixture according to the invention, whose oxygen activity is smaller than that required for the formation of manganese(II) oxide or chromium(III) oxide, are not oxygen-containing (oxygen-free), so that there is almost no oxygen partial pressure. The carbon transfer from the gas phase into the steel during the initial phase and diffusion phase is large and the required carbon content in the surface of the material (about 1% C) is established relatively quickly. At the carburization temperatures, the unstable hydrocarbon ($C_xH_y$) on the alloy surface decomposes mainly to hydrogen, methane and atomic carbon which rapidly diffuses into the material. The decomposition can, for example when propane is used, proceed in accordance with the following equation:

$$C_3H_8\rightarrow 2\ CH_4+C_{ad}$$

$$C_{ad}\leftrightarrows[C]_{dissolved}$$

The carbon activity being established in the gas phase is affected by the added quantity of hydrocarbon. Since the gas phase consists mainly of hydrogen, the C level is controlled via the methane/hydrogen ratio being established. The carburization reaction via the methane decomposition in hydrogen atmospheres proceeds as follows:

$$\boxed{CH_4=C+2\ H_2}$$

The hydrogen content and especially the methane content being established are continuously analyzed, and the hydrocarbon addition is controlled at a desired surface carbon content by reference to the detected actual values.

If, however, great depths of carburization are demanded, i.e. long carburization times (more than 8 hours), the hydrogen/hydrocarbon gas mixture can be exchanged for a diluted cracked nitrogen/methanol gas towards the end of the carburization phase. This carburization variant is thus a two-stage carburization process:

1st stage main carburization phase

2nd stage diffusion phase

During the diffusion phase (about 1 to 2 hours), the hydrogen dissolved in the workpiece during the main carburization phase is greatly reduced, so that hydrogen embrittlement can be excluded.

For the single-stage process, the carbon-containing gas mixture is replaced by nitrogen after the carburization and the hydrogen dissolved in the steel is thereby reduced. The steel is held in the nitrogen atmosphere for between 5 and 15 minutes.

If hardening is carried out at a temperature lower than the carburization temperature, it is possible to flush with nitrogen during the cooling phase down to hardening temperature, in order to reduce the dissolved hydrogen. The carburization phase can thus be utilized to the extent of 100%.

EXAMPLES

16 MnCr 5 steel (1% of Mn; 1% of Cr; 0.20% of Si) was carburized in an industrial furnace installation. The furnace installation was conditioned with endothermic gas at about 1,000° C. before the first carburization. During the conditioning, the temperature and thermal voltage of the oxygen probe or the dew point or the $CO_2$ content were measured and recorded, and unambiguous information about the quality of the furnace conditioning was obtained. The course of the carburization was carried out as follows:

Single-stage process

1st step: Move steels into the furnace and flush with nitrogen ($N_2$) until oxygen-free.

2nd step: Heat the steels to the carburization temperature under a nitrogen/hydrogen atmosphere.

3rd step: Starting at a temperature of 750° C., feed a hydrogen/propane gas mixture.

4th step: Carburize the steels at preset holding time and holding temperature in the hydrogen/propane furnace atmosphere.

5th step: About 1 to 2 hours before the holding time has elapsed, the C level of the furnace atmosphere is controlled by addition of propane to the value which sets a desired surface carbon content in the steel.

6th step: Flush the furnace space with nitrogen (high flushing rate) and hold the steels for about 10 minutes at the temperature or cool it down to the hardening temperature.

7th step: Harden the steels.

Two-stage process

1st step: Move the steels into the furnace and flush with nitrogen ($N_2$) until oxygen-free.

2nd step: Heat the steels to the carburization temperature under a nitrogen ($N_2$)/hydrogen ($H_2$) atmosphere.

3rd step: Starting at a temperature of 750° C., feed a hydrogen/hydrocarbon gas mixture.

4th step: Carburize the steels at a preset holding time and holding temperature in the hydrocarbon furnace atmosphere.

5th step: About 1 to 2 hours before the holding time (carburization time) has elapsed, the gas atmosphere is replaced by a cracked nitrogen/methanol gas.

6th step: About 1 to 2 hours before the holding time has elapsed, the C level of the furnace atmosphere (C level control via oxygen probe, $CO_2$ content or water content) is controlled by adding propane or other hydrocarbons to the value which sets a desired surface carbon content in the steel.

7th step: Cool the steels to the hardening temperature.

8th step: During the cooling to the hardening temperature, the C level is kept constant at the desired value.

9th step: Harden the steels.

In both process variants, the furnace gas composition was continuously analyzed during the entire process for its contents of $H_2$, $CH_4$, CO, $CO_2$ and $H_2O$. The temperature curve was also measured and recorded. The carbon activity and oxygen activity were continuously determined and corrected towards their set values.

I claim:

1. A process for avoiding internal oxidation in the carburization of steels with alloy elements under a carbon-containing gas mixture at the carburization temperature at atmospheric pressure, which comprises heating the steels to the carburization temperature under a hydrogen containing gas selected from the group consisting of a nitrogen/hydrogen gas mixture and a pure hydrogen gas, and carburizing with a hydrogen/hydrocarbon-containing gas mixture having an oxygen activity smaller than that required for the formation of manganese (II) oxide or chromium (III) oxide by controlling the amount of oxygen containing molecules, whereby the hydrogen/hydrocarbon-containing gas mixture makes available carbon which diffuses into the steel.

2. The process claimed in claim 1 wherein the hydrogen/hydrocarbon gas mixture is a hydrogen/propane gas mixture.

3. The process as claimed in claim 1, wherein the hydrogen/hydrocarbon-containing gas mixture is replaced towards the end of the carburization by a cracked nitrogen/methanol gas.

4. The process as claimed in claim 3, wherein the composition of the hydrogen/hydrocarbon containing gas mixture or of the cracked gas is detected during the heating and carburization and, as a function of the detected actual values, the carbon content is adjusted to a desired surface carbon content by adding hydrocarbons.

5. The process as claimed in claim 4, wherein the hydrogen/hydrocarbon-containing gas mixture or the cracked gas is replaced by nitrogen after the carburization and the hydrogen dissolved in the steel is thereby reduced.

6. The process as claimed in claim 5, wherein the steel is held at the carburization temperature for between 5 and 15 minutes in the nitrogen atmosphere.

7. The process as claimed in claim 5, wherein the steel is cooled in the nitrogen atmosphere to a temperature below the carburization temperature.

8. The process as claimed in claim 3, wherein the hydrogen/hydrocarbon-containing gas mixture or the cracked gas is replaced by nitrogen after the carburization and the hydrogen dissolved in the steel is thereby reduced.

9. The process as claimed in claim 1, wherein the composition of the hydrogen/hydrocarbon containing gas mixture or of the cracked gas is detected during the heating and carburization and, as a function of the detected actual values, the carbon content is adjusted to a desired surface carbon content by adding hydrocarbons.

10. The process as claimed in claim 9, wherein the steel is held at the carburization temperature for between 5 and 15 minutes in a nitrogen atmosphere.

11. The process as claimed in claim 9, wherein the steel is cooled in a nitrogen atmosphere to a temperature below the carburization temperature.

* * * * *